United States Patent [19]

McCachren

[11] 3,992,785

[45] Nov. 23, 1976

[54] HAIR DRYER HOOD

[75] Inventor: Gary S. McCachren, Asheboro, N.C.

[73] Assignee: General Electric Company, Bridgeport, Conn.

[22] Filed: May 6, 1975

[21] Appl. No.: 574,862

[52] U.S. Cl. ..... 34/99

[51] Int. Cl.[2] ..... A45D 20/24

[58] Field of Search ..... 34/90, 91, 96–101, 34/239; 132/7, 9; 239/600; 219/366–371

[56] References Cited

UNITED STATES PATENTS

| | | | |
|---|---|---|---|
| 1,762,588 | 6/1930 | Rainey | 34/99 |
| 1,840,963 | 1/1932 | Levy | 34/99 |
| 1,842,001 | 1/1932 | Zainfeld | 34/99 |
| 2,810,967 | 10/1957 | Jacobus | 34/99 |
| 3,348,316 | 10/1947 | Reiss et al. | 34/99 |
| 3,513,563 | 5/1970 | Ziegler | 34/99 |
| 3,645,007 | 2/1972 | Scott | 34/99 |
| 3,763,573 | 10/1973 | Bartram et al. | 34/99 |

*Primary Examiner*—Kenneth W. Sprague
*Assistant Examiner*—James C. Yeung
*Attorney, Agent, or Firm*—John F. Cullen; George R. Powers; Leonard J. Platt

[57] ABSTRACT

A hair dryer hood of a smooth outer shell and a smaller rigid perforated inner liner having a space therebetween to distribute heated air from a source of supply and both having an opening for a user's head. To this standard structure an improvement comprises means to change or vary the volume of the inner liner substantially within the fixed confines of the outer shell by providing a separate quick connect/disconnect to easily change or replace inner liners of different size so the inner liners can be selectively connected to the outer shell and the dryer characteristics of inner volume, drying time, drying efficiency, and air penetration can all be varied without changing the basic hair dryer design.

1 Claim, 3 Drawing Figures

HAIR DRYER HOOD

BACKGROUND OF THE INVENTION

1. Field of the Invention

The invention is directed to an improved hair dryer hood of the type that has a smooth outer shell and a spaced perforated inner liner with a space therebetween to distribute heated air from a source of supply. Different sized inner liners are provided to be quickly connected/disconnected from the outer shell to change the functional characteristics of the dryer without changing the basic design.

2. Description of the Prior Art

One of the popular home hair dryers is the stand or rigid hood type dryer with the motor and fan assembly in a base that may be placed on a table and an air conduit supports the hood at a convenient height for the user when sitting in a chair. Such dryers present storage and carrying problems and various means have been devised whereby the rigid hood is folded onto the base in a bell-like structure well known in the art and of the general type shown in U.S. Pat. No. 3,513,563. Such dryers are generally known as salon dryers, as opposed to the soft bonnet type, and come in basically two hood liner sizes. There are salon dryers with small liners about eleven inches in diameter and eight inches deep and larger dryers with liners about twelve inches in diameter and eight and one-half inches deep to accommodate different sized heads and larger rollers. The larger have the advantage of accommodating larger rollers and heads but have the disadvantages of wasting air flow thus decreasing efficiency and increasing drying time when used with small rollers and heads. On the other hand, the smaller liners have the disadvantage of not accommodating larger rollers and heads but the distinct advantage of effectively and efficiently drying hair when used with smaller rollers and heads. The prior art has generally involved a compromise between these mutually exclusive conditions and structures. Also, it is known to provide salon dryers with a variable drying cavity. Typically, the hood may use an eyelid that can be lowered over the eyes to increase the air captive volume and thus change the volume of the inner liner and this may be used with hair rollers or merely for faster drying. The folding lid permits the hood to be reduced for storage and a typical example of this device is shown in U.S. Pat. No. 3,513,563 supra. Others provide a cut-out portion in the hood in the form of a visor that can be swung back for easier entry to the hood and is then closed, to provide more of the hood over the head as shown in U.S. Pat. No. 2,810,967. Generally, dryers that change the volume for the heated air have used hood extensions or lids or visors and have selected a fixed inner liner that would best handle different head sizes and roller sizes. Thus, the salon dryers with means for varying the volume drying cavity have resulted in complex structures that, at best, represent a compromise. The present invention provides a means to change the volume of the inner liner within the fixed confines of the outer shell by providing separate detachable different-sized inner liners that can be selectively connected to the outer shell by a quick connect/disconnect interlock.

SUMMARY OF THE INVENTION

Briefly described, the invention is a hair dryer hood of the type that has a preferably rigid imperforate and generally smooth outer shell and a smaller rigid perforated inner liner with a space therebetween to distribute heated air from a source of supply in the base with both the shell and liner having an opening for the user's head. In this arrangement, the invention provides an improvement which comprises a means to change or vary the volume of the inner liner substantially within the fixed confines of the outer shell by providing means to use separate detachable different-sized fixed volume inner liners that can be selectively connected to the outer shell by a quick connect/disconnect type of interlock support means and the separate liners are sized so they nest together for easy storage. The arrangement permits easy change of the volume of the inner liner whereby the functional characteristics of inner volume, drying time, drying efficiency, and air penetration can all be varied without changing the basic hair dryer design. Thus, the main object of the invention is to provide an improved hair dryer hood generally of the rigid type so that, without changing the basic design, the inner volume may be conveniently and easily changed by changing the liner size.

DESCRIPTION OF THE PREFERRED EMBODIMENT

Figure 1:
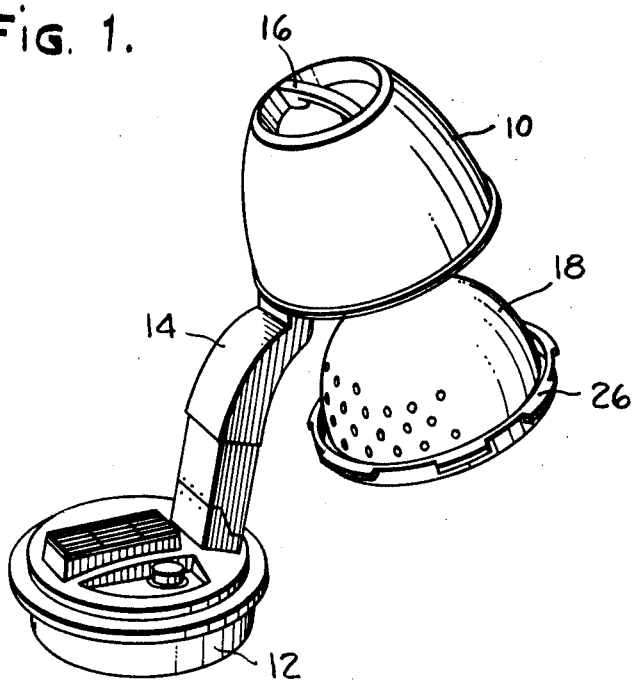
FIG. 1 is a perspective, partly in phantom, of a salon hair dryer with the inner liner removed.

Referring to FIG. 1, a typical salon hair dryer has a hood formed of a half-spherical smooth outer shell 10 supported from a base 12 that contains the usual source of supply of heated air. The heated air is directed to the hood by the usual conduit 14, which is adjustable and foldable onto lower shell 10 over the base for storage and easy carrying by handle means 16, all as well known in the art.

To distribute heated air, the smooth or imperforate outer shell 10, generally although not necessarily rigid, has at least one smaller spaced rigid perforated inner liner 18 with an opening to permit insertion of a person's head and that is nested within shell 10 and firmly secured thereto around the periphery of the head opening of both the shell and liner. Heated air from conduit 14 flows into space 20 between the shell and liner where it is then directed through distributing apertures 22 to dry the head of the user as seen in FIG. 2.

As previously noted, salon hair dryers basically come in two permanently-secured liner sizes-large and small. The present invention provides the advantages of both large and small inner liner sizes with the disadvantages of neither by providing means to change the inner volume in a dryer with interchangeable hood liners that can be easily snapped in or out as the application demands.

Figure 3:
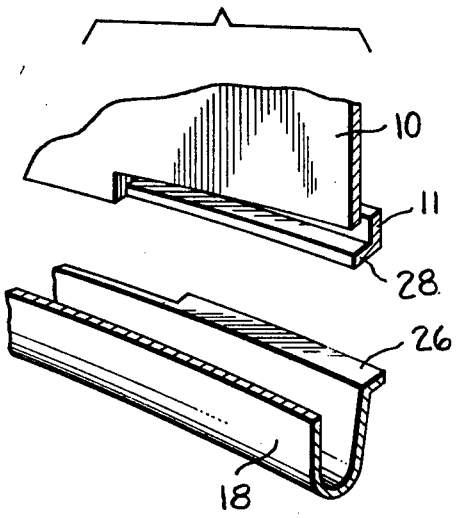
FIG. 3 is a partial perspective of a typical quick interlock between the liner and shell.
Figure 2:
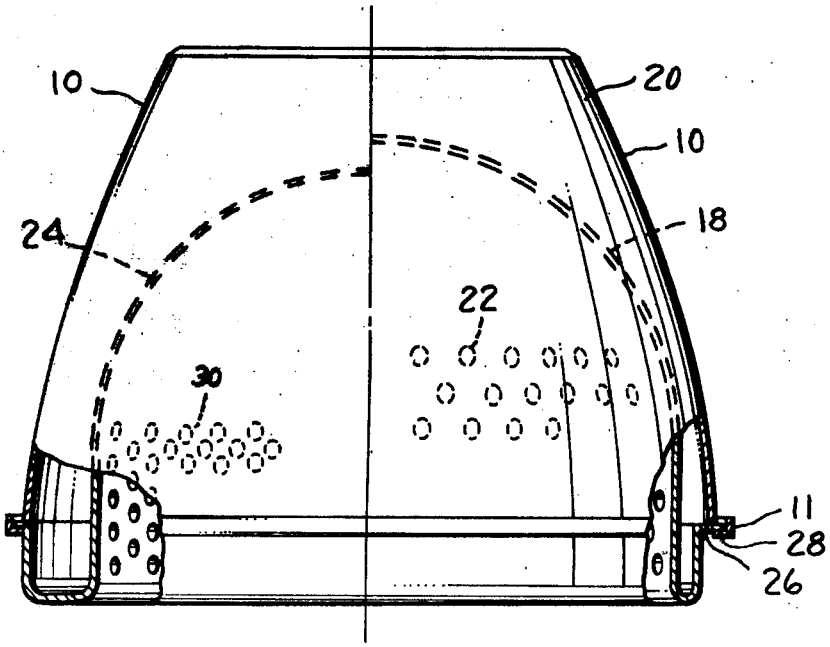
FIG. 2 is a partial cross section through the hood structure showing different sized and apertured liners in the common hood.

To make the device usable, it is necessary that a quick connect/disconnect type attachment interlock be provided between at least two sized liners such as a first large liner 18 and a second different sized such as smaller liner 24 as shown in FIG. 2. Any suitable quick interlocking latching or mating attachment structure to removably connect the parts may be used between the shell and liners such as screwing the parts together and FIG. 3 shows a typical preferred arrangement for rapid changing of the inner liner. As shown, liner 18 may be provided around its opening periphery with segment extensions 26 and the outer shell 10 is provided with an annular support means 11 with an interior opening substantially the size of perforated liner 18 opening and having mating or matching recess 28 thereon with the inner liner being pushed into the shell and rotated so extensions 26 slide into recess 28 and connect the inner liner in place bayonet-like to interlock the shell and liner. The shell and liner recesses 28 and extensions 26 can each be molded with a slight radius so the interference would increase as the angular displacement is increased. Thus, the liners are rotated for attachment together until a snug fit exists to provide a quick connect/disconnect interlock between the shell and liner around their respective annular openings. Thus, smaller liner 24 may replace larger liner 18 of a first interior volume by merely removing liner 18, aligning the openings, and substituting liner 24 of a second interior volume on the annular support of outer shell 10 for rapidly changing the size of the inner liner.

To keep the entire package compact and handy, the liners can be sized to nest together and FIG. 2 illustrates how liner 24 can be sized to be inserted within liner 18 in a smooth fit straddling the bottom of liner 18 to abut recesses 28 so that, in the folded condition, the conventional latching means between base 12 and shell 10 holds both the shell 10 and the two interchangeable liners in a compact locked arrangement for storage and carrying.

The quick interchangeable liner concept thus provides a means to change the volume of the inner liner and to do it substantially within the fixed confines of the outer shell as clearly shown in FIG. 2. No complicated additional extensions to the outer shell in the form of lids, visors, or the like are necessary. Additionally, the different liners 18 and 24 may have different sized and spaced apertures 22 and 30 respectively for various purposes. For example, smaller and more numerous apertures 30 in place of apertures 22 may handle the same air flow at higher velocities thus providing more air penetration if desired. If a user with a smaller head or smaller rollers uses larger liner 18, there is wasted air flow because of the too large volume thereby decreasing the efficiency of the dryer and increasing the drying time. By quickly and easily changing to the smaller liner 24, there is less waste of heated air and the drying efficiency is increased because of the smaller volume and consequently drying time will be decreased.

The use of selectively connected different sized liners thus permits the salon dryer to provide a great flexibility and permits the functional characteristics of inner volume, drying time, drying efficiency, and air penetration to all be varied without ever changing the basic hair dryer design meaning it is unnecessary to redo or redesign any of the parts or functions upstream of the hood which would normally be the case when changing the above characteristics. The arrangement permits easy storability, carrying, and rapid interchange of any reasonable number of liners to meet varying requirements.

While I have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. A hair dryer comprising:

a first perforated liner having an opening to the interior thereof the size of the opening being selected to permit the insertion of a person's head into the interior of the perforated liner, support means having an interior opening of substantially the size of said opening to the interior of said perforated liner, a second separate perforated liner having an opening to the interior thereof, the size of the opening being selected to permit the insertion of a person's head into the interior and such opening being different sized from the opening of said first perforated liner, mating mounting means on said support means and each perforated liner for permitting either said perforated liner to be removably mounted on said support means with the openings of said mounted liner and said support means aligned, whereby the hair drying volume of the hair dryer may be readily changed by removing a liner of a first interior volume from said support means and mounting a liner of a second interior volume on said support means.

* * * * *